United States Patent [19]

Nurminen et al.

[11] 3,981,352

[45] Sept. 21, 1976

[54] METAL CASTING MOLD WITH BONDED PARTICLE FILTER

[75] Inventors: John I. Nurminen, North Muskegon, Mich.; David H. Sturgis, Gladstone, Oreg.

[73] Assignee: Howmet Corporation, Greenwich, Conn.

[22] Filed: Nov. 21, 1975

[21] Appl. No.: 634,045

[52] U.S. Cl. ..... 164/358; 164/134; 210/263

[51] Int. Cl.[2] ..... B22C 9/08

[58] Field of Search ..... 164/358, 134; 249/105; 210/263

[56] References Cited

UNITED STATES PATENTS 3,815,661 6/1974 Curran et al. ..... 164/134

FOREIGN PATENTS OR APPLICATIONS 627,856 8/1949 United Kingdom ..... 210/263

*Primary Examiner*—Robert D. Baldwin

*Attorney, Agent, or Firm*—McDougall, Hersh & Scott

[57] ABSTRACT

A system for the casting of metal comprising a filter through which the metal passes during pouring into a mold cavity. The filter is formed by providing a multiplicity of substantially spherical refractory particles. A ceramic binder is employed for securing the particles in a bonded assembly, the binder substantially completely coating the particles. Openings are defined between the adjoining coated particles to permit the flow of molten metal through the filter. The binder is of a type having an affinity for dross and slag constituents in the molten metal whereby the constituents are removed during passage of the metal through the filter. The refractory particles are preferably bonded into an assembly by processing which includes coating the particles with the binder material, introducing the coated particles into a mold and drying and firing the coated particles in the mold to achieve the desired bonded relationship.

5 Claims, 3 Drawing Figures

METAL CASTING MOLD WITH BONDED PARTICLE FILTER

This invention relates to metal casting operations. In particular, the invention is concerned with a molten metal filter and with a process for the production of the filter, the filter being useful during the casting of metal whereby dross and slag and inclusions can be removed during pouring of molten metal into a mold.

In the course of conventional melting processes, molten metal is contained in a melting crucible, usually a refractory metal oxide crucible. The molten metal is held in such a crucible until it has reached a temperature suitable for casting with further delays possible being occasioned by the necessity for mold preparation and other required steps in a casting operation.

During the melting and holding period, certain reactive metals containing reactive alloying elements may react with the furnace atmosphere and with the melt crucible to form slag constituents on the surface of the melt as well as dross particulates within the melt. Furthermore, solid oxide particles may flake off the melt crucible during melting and pouring thereby adding additional impurities and inclusions to the molten alloy. Such conditions are prevalent in the case of air melting and are also recognized in the case of vacuum melting or melting taking place in the presence of an inert gas.

The presence of slag constituents, dross particles, and other impurities, can adversely affect the properties of the alloys being cast. In the case of certain superalloy and titanium alloy castings which are to be used for high temperature applications such as turbine blades, any drop-off in properties cannot be tolerated. Accordingly, conventional melting techniques have led to a significant scrap rate.

It is a general object of this invention to provide an improved technique for the casting of molten metal whereby the resulting castings will not be characterized by any significant amounts of undesirable impurities.

It is a more particular object of this invention to provide an improved liquid metal filter whereby undesirable impurities in molten metal can be efficiently removed from the metal in the course of pouring of the metal into a mold.

It is a still further object of this invention to provide an improved process for the production of a liquid metal filter of the type referred to.

These and other objects of this invention will appear hereinafter and for purposes of illustration but not of limitation, a specific embodiment of the invention is shown in the accompanying drawings in which.

Figure 1:
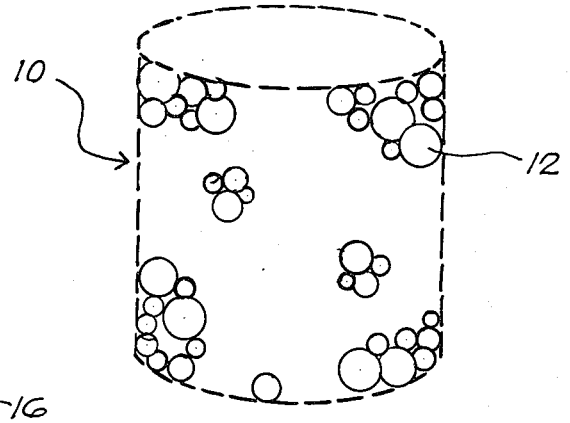
FIG. 1 is a perspective view illustrating a liquid metal filter of the type contemplated by this invention.

The subject matter of this invention generally relates to the casting of metal. The invention is concerned with the formation of castings which are particularly characterized by the substantial absence of undesirable inclusions resulting from the presence of dross and slag in the melting crucible. Such inclusions adversely affect properties of castings, and the adverse affect is particularly critical where the castings are to be used in high performance applications. Accordingly, the invention is of particular importance with reference to the casting of superalloys, titanium and the like since such metals are employed in applications which require particularly superior properties.

The invention is concerned with a filter construction utilized during pouring of castings whereby dross and slag constituents can be removed from the molten metal to thereby eliminate or significantly reduce the presence of such constituents in the ultimate castings. The invention is also concerned with procedures for producing such filters.

More specifically, the filter construction of the invention comprises a multiplicity of substantially spherical refractory particles. A ceramic binder is utilized for securing the particles in a bonded assembly, the binder composition substantially completely coating the particles. The bonded assembly is characterized by openings defined between the adjoining coated particles to thereby permit the flow of molten metal through the filter. The binder is characterized by an affinity for dross and slag constituents in the molten metal so that all or substantially all of such constituents can be removed.

In the production of filters of the type described, the spherical refractory particles are preferably intermixed with a liquid slurry formed of at least portions of the binder material whereby the spheres are coated. The combination is located in a mold of the desired filter configuration and then dried and fired whereby a bonded assembly is achieved. Depending upon the composition of the binder, chemical additives may be utilized to achieve an appropriate chemical state prior to the drying and firing.

The refractory particles advantageously comprise alumina or zirconia; however, refractory materials such as silica, titania, fused quartz, thoria, mullite, chromite, zirconium silicates, beryl ores, zirconite, kyanite, silmonite, calcined alumina, other highly reactive oxides and silicates and ores of refractory metals, or the like may be employed. The particles may be either solid or hollow particles, and the latter provide some advantages in that filters made from the hollow particles are less subject to thermal shock.

The binder employed must have an affinity for the slag and dross inclusions and, accordingly, particular binders may be more suitable than others depending upon the alloy being cast. It is also desirable to employ a binder having the same or substantially the same thermal coefficient of expansion as the refractory spheres to avoid reacting or other problems which can develop when severe changes in temperature are encountered. It is for this reason that calcined alumina is preferably employed as the major constituent of a binder where alumina comprises the refractory spheres. Calcia stabilized zirconia is preferably utilized as the main binder constituent in the case of a filter utilizing zirconia spheres. Both the alumina and zirconia binders provide coatings for spheres which have an affinity for troublesome slag and dross inclusions, for example, the reaction products of aluminum, titanium, zirconium, tantalum, chromium and hafnium which comprise slag and dross constituents in the casting of superalloys. These binder and coating compositions are also suitable for picking up oxide particles from a melt where such particles flake off of the melt crucible during melting and pouring.

The refractory spheres may vary in size, and this provides a means for controlling the characteristics of a filter. Thus, larger spheres up to ¼ inch in diameter will result in larger interstices, and, accordingly, a higher flow rate of molten metal through the filter. Smaller spheres provide a reduced flow rate; however, these provide greater surface area and consequently increased filtering capability. Spheres ranging in size between 4 mesh and 8 mesh are most commonly used.

In the manufacturing process, the coated refractory spheres are located in a mold, and a tamping pressure may then be applied with a view toward insuring filling of the mold. Variations in pressure are also useful for changing the density of the material in the mold and thereby providing a means for varying filtering characteristics.

The following comprise specific examples of the practice of the invention. These examples involve the formation of a filter utilizing bubbled or hollow alumina refractory spheres and a mullite bond.

EXAMPLE I

The ingredients employed were as follows: +6 mesh bubbled alumina — 48 pts. by wt. Calcined alumina (Alcoa A-17 grade) — 30 pts. by wt. Prehydrolyzed ethyl silicate (18% $SiO_2$) — 5.5 pts. by wt. Morpholine — 1.0 pt. by wt.

The following procedural steps were employed for achieving the filter construction:

1. Mix calcined alumina and ethyl silicate to obtain a smooth slurry.
2. Add bubbled alumina and mix until all particles are coated.
3. Add morpholine, mix 15–30 seconds, and tamp into mold of desired configuration.
4. Dry and fire at 2950°F for 2 hours.

EXAMPLE II

The ingredients employed were as follows: −4+8 mesh bubbled alumina — 48 pts. by wt. calcined slumina (Alcoa A-17) — 30 pts. by wt. Prehydrolyzed ethyl silicate (18% $Sio_2$) — 5.5 pts. by wt. Morpholine — 1.0 pt. by wt.

The following procedural steps were employed for achieving the filter construction:

1. Mix calcined alumina and ethyl silicate to obtain a smooth slurry.
2. Add bubbled alumina and mix until all particles are coated.
3. Add morpholine, mix 15–30 seconds, and tamp into mold of desired configuration.
4. Dry and fire at 2950°F for 2 hours.

EXAMPLE III

The ingredients employed were as follows: −8+12 mesh bubbled alumina — 48 pts. by wt. Calcined alumina (Alcoa A-17) — 30 pts. by wt. Prehydrolyzed ethyl silicate (18% $SiO_2$) — 5.5 pts. by wt. Morpholine - 1.0 pt. by wt.

The following procedural steps were employed for achieving the filter construction:

1. Mix calcined alumina and ethyl silicate to obtain a smooth slurry.
2. Add bubbled alumina and mix until all particles are coated.
3. Add morpholine, mix 15–30 seconds, and tamp into mold of desired configuration.
4. Dry and fire at 2950°F for 2 hours.

EXAMPLE IV

The ingredients employed were as follows: Mixture of 3 sizes, +6 mesh −4+8 mesh and −8+12 mesh bubbled alumina in any proportions desired —48 pts. by wt. Calcined alumina (Alcoa A-17) — 30 pts. by wt. Prehydrolyzed ethyl silicate (18% $SiO_2$) — 5.5 pts. by wt. Morpholine —1.0 pt. by wt.

The following procedural steps were employed for achieving the filter construction:

1. Mix calcined alumina and ethyl silicate to obtain a smooth slurry.
2. Add bubbled alumina and mix until all particles are coated.
3. Add morpholine, mix 15–30 seconds, and tamp into mold of desired configuration.
4. Dry and fire at 2950°F for 2 hours.

EXAMPLE V

The ingredients as set forth in Example I were employed with the omission of morpholine. The following procedural steps were followed:

1. The calcined alumina and ethyl silicate were mixed to obtain a smooth slurry.
2. The bubbled alumina was added to the mix until all particles were coated.
3. The coated particles were tamped into a mold and the coated particles were then exposed to an anhydrous ammonia gas to gel the binder composition in the mold.
4. The resulting assembly was dried and fired at 2950°F for 2 hours.

The following additional examples relate to the use of bubbled zirconia spheres and a zircon bond.

EXAMPLE VI

The ingredients employed were as follows: −8+12 mesh bubbled zirconia — 60 pts. by wt. −325 mesh calcia stabilized zirconia — 30 pts. by wt. Prehydrolyzed ethyl silicate (18% $SiO_2$) — 4.6 pts. by wt. Morpholine — 1.0 pt. by wt.

The following procedural steps were employed for achieving the filter construction:

1. Mix calcia stabilized zirconia and ethyl silicate to obtain a smooth slurry.
2. Add bubbled zirconia and mix until all particles are coated.
3. Add morpholine, mix 15–30 seconds, and tamp into mold of desired configuration.
4. Dry and fire at 2950°F for 2 hours.

EXAMPLE VII

The ingredients employed were as follows: +6 mesh bubbled zirconia — 60 pts. by wt. −325 mesh calcia stabilized zirconia — 30 pts. by wt. Prehydrolyzed ethyl silicate — 4.6 pts. by wt. Morpholine — 1.0 pt. by wt.

The following procedural steps were employed for achieving the filter construction:

1. Mix calcia stabilized zirconia and ethyl silicate to obtain a smooth slurry.
2. Add bubbled zirconia and mix until all particles are coated.
3. Add morpholine, mix 15–30 seconds, and tamp into mold of desired configuration.
4. Dry and fire at 2950°F for 2 hours.

EXAMPLE VIII

The ingredients employed were as follows: +6 mesh bubbled alumina — 48 pts. by wt. Calcined alumina (Alcoa A-17) — 30 pts. by wt. Colloidal alumina (Philadelphia Quartz Produce Q-Loid A-30) — 12 pts. by wt.

The following procedural steps were utilized:

1. Mix calcined alumina and colloidal alumina to obtain a smooth slurry.
2. Add the bubbled alumina and mix until all particles are coated.
3. Tamp mixture into mold of desired configuration.
4. Dry (in mold) at 50°C.
5. Fire at 2950°F for 2 hours.

In addition to the morpholine, the utilization of a chemical gelling agent such as the anhydrous ammonia gas is also contemplated with respect to the bubbled zirconia-zircon bond compositions, and it will be understood that various additional conventional gelling agents may be employed such as ammonium hydroxide and magnesium oxide. Reference is also made to U.S. Pat. No. 2,046,209 in this regard.

When dealing with spherical refractory particles other than alumina and zirconia, it will be apparent that compatible binder compositions can be readily selected in view of known existing practice. The affinity for the particular undesirable inclusions in a molten metal composition can be determined by testing, it being understood that the nature of such inclusions will vary depending upon the type of metal being prepared for casting and depending upon the melting conditions.

Filters produced in accordance with the foregoing may assume the cylindrical shape of the filter 10 illustrated in FIG. 1 or such other shape as might be suitable for a particular operation. As indicated, the filter is made up of a plurality of individual spherical particles 12, and the openings defined between the respective particles provide for the filtering capability.

Figure 2:
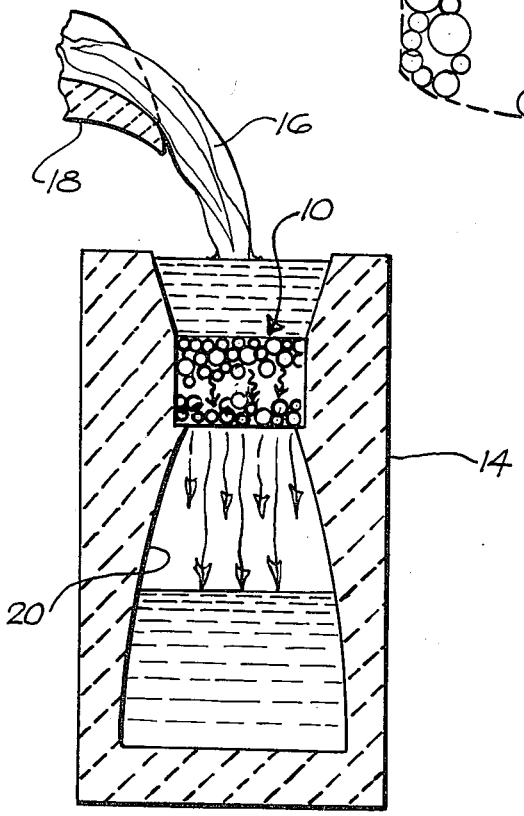
FIG. 2 is a vertical, sectional view illustrating a casting mold characterized by a liquid metal filter of the type contemplated by this invention.

FIG. 2 illustrates a mold 14 with a filter 10 located in position for contact with molten metal 16 being poured from crucible 18. As indicated, all of the molten metal must pass through the filter on its way to the mold cavity 20.

Figure 3:
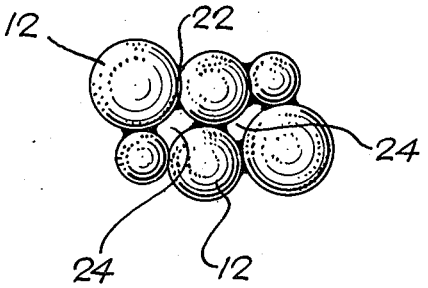
FIG. 3 is a fragmentary view of a liquid metal filter illustrating a plurality of assembled filter particles in bonded assembly.

FIG. 3 illustrates a fragmentary section of a filter produced in accordance with this invention. As indicated, each of the spherical particles 12 is bonded together by a binder material 22, and the binder material also forms a skin or coating over the spheres in addition to serving as the binding agent. This results in an assembly of spheres with openings 24 defined between adjacent spheres, and with surfaces formed of the binder composition being exposed for contact by the molten metal.

It is also comtemplated that improved wetting of the filter by a molten alloy may be accomplished by the formation of an additional coating over the coating provided by the binder composition. Thus, by dipping a filter in a liquid slurry or by means of vapor phase deposition, a surface which is more prone to wetting could be provided. Such coating may comprise various oxides, carbides, nitrides, intermetallics, metals, and other materials which will display a particular affinity for undesirable inclusions. Utilization of such coatings is specifically contemplated in the case of alloys which may form inclusions which are particularly difficult to remove.

It will be understood that various changes and modifications may be made in the above described invention without departing from the spirit of the invention.

That which is claimed is:

1. The combination of a mold for casting metal and a filter construction associated therewith, said mold including a passage for the introduction of molten metal into a mold cavity, said filter being located in said passage whereby the molten metal passes through the filter during filling of the mold, the improvement wherein said filter comprises a multiplicity of substantially spherical, refractory particles, and a ceramic binder securing said particles in bonded assembly, said binder substantially completely coating the particles, openings defined between the coated particles to permit the flow of molten metal through the filter, said binder having an affinity for inclusions in the molten metal including dross and slag constituents whereby such inclusions are removed during passage of metal through the filter.

2. A combination in accordance with claim 1 wherein said particles range in size between 4 mesh and 12 mesh.

3. A combination in accordance with claim 1 wherein said particles comprise hollow spheres.

4. A combination in accordance with claim 3 wherein said particles comprise a refractory oxide selected from the group consisting of alumina and zirconia.

5. A combination in accordance with claim 4 wherein said binder comprises at least one refractory oxide as a major constituent.

* * * * *